US005638800A

United States Patent [19]

Furuya et al.

[11] Patent Number: 5,638,800

[45] Date of Patent: Jun. 17, 1997

[54] METHOD AND APPARATUS FOR CONTROLLING AIR-FUEL RATIO LEARNING OF AN INTERNAL COMBUSTION ENGINE

[75] Inventors: Junichi Furuya; Atsushi Murai, both of Atsugi, Japan

[73] Assignee: Unisia Jecs Corporation, Kanagawa-ken, Japan

[21] Appl. No.: 563,424

[22] Filed: Nov. 28, 1995

[30] Foreign Application Priority Data

Dec. 8, 1994 [JP] Japan ..... 6-304790

[51] Int. Cl.[6] ..... F02D 41/16

[52] U.S. Cl. ..... 123/674; 123/680

[58] Field of Search ..... 123/674, 675, 123/680; 364/431.05, 431.12

[56] References Cited

U.S. PATENT DOCUMENTS

| | | | |
|---|---|---|---|
| 4,737,914 | 4/1988 | Abe et al. | 123/674 |
| 4,862,855 | 9/1989 | Manaka et al. | 123/674 |
| 4,864,997 | 9/1989 | Miyachi | 123/674 |
| 4,913,122 | 4/1990 | Uchida et al. | 123/674 |
| 4,924,836 | 5/1990 | Uchida et al. | 123/674 |
| 5,099,817 | 3/1992 | Nakaniwa | 123/674 |
| 5,243,951 | 9/1993 | Nakaniwa | 123/674 |
| 5,341,641 | 8/1994 | Nakajima et al. | 123/674 |
| 5,361,582 | 11/1994 | Uchida et al. | 123/674 |
| 5,400,761 | 3/1995 | Fukasawa et al. | 123/674 |

FOREIGN PATENT DOCUMENTS

| | | |
|---|---|---|
| 60-90944 | 5/1985 | Japan . |
| 61-190142 | 8/1986 | Japan . |

*Primary Examiner*—Willis R. Wolfe

*Attorney, Agent, or Firm*—Lowe, Price, LeBlanc & Becker

[57] ABSTRACT

An object of the present invention is to carry out air-fuel ratio learning to a high accuracy even in a region such as the idling region wherein the number of acquisitions of air-fuel ratio feedback correction values within a predetermined period is small. Average values A for one fluctuation period of an air-fuel ratio feedback correction coefficient $\alpha$ are computed and stored in order of computation in a RAM, and an arithmetical mean value B obtained. A weighted average value C of a previous learning correction coefficient $_{KL}$ and the arithmetical mean value B is then obtained ($C=X\cdot B+(1-X)\cdot K_L$). The weighting proportion X is set larger the larger the number of acquisitions of the average value A. C is updated/set as a new learning correction coefficient $K_L$. In this way, since the updating/setting treatment of the learning correction coefficient $K_L$ is carried out in accordance with the acquisition conditions of $\alpha$, then even in a region such as the idling region wherein the number of acquisitions of the average value A per predetermined period is small, updating/setting of the learning correction coefficient $K_L$ can be expedited with minimal influence from an unstable $\alpha$ immediately after commencing air-fuel ratio feedback control. Therefore learning opportunities similar to those for the high speed region can be provided. Moreover due to learning being expedited, the learning correction coefficient $K_L$ can have a higher reliability than for a conventional arrangement.

14 Claims, 7 Drawing Sheets

METHOD AND APPARATUS FOR CONTROLLING AIR-FUEL RATIO LEARNING OF AN INTERNAL COMBUSTION ENGINE

BACKGROUND OF THE INVENTION

1. Field of the Invention

The present invention relates to a method and apparatus for controlling air-fuel ratio learning of an internal combustion engine, and more particularly to control technology for modifying a method of updating/setting treatment of an air-fuel ratio learning correction value in accordance with acquisition conditions of air-fuel ratio feedback correction values.

2. Description of the Related Art

As conventional air-fuel ratio feedback controllers incorporating a learning function, there are for example the devices disclosed in Japanese Unexamined Patent Publication Numbers 60-90944, and 61-190142.

With these devices, air-fuel ratio feedback control involves determining the richness/leanness of the actual air-fuel ratio with respect to a target air-fuel ratio (for example the stoichiometric air-fuel ratio), by comparing an output value of an oxygen sensor provided in an engine exhaust system with a slice level (a value corresponding to a target air-fuel ratio), and then incrementing/decrementing an air-fuel ratio feedback correction coefficient $\alpha$ by proportional/integral control and the like, based on the determined results. A basic fuel injection quantity Tp computed from, the intake air flow quantity detected by an air flow meter, and the engine rotational speed, is then corrected with the air-fuel ratio feedback correction coefficient $\alpha$, to minimize a deviation of the actual air-fuel ratio from the target air-fuel ratio, due for example to component errors and deterioration with time, or to environmental changes.

Moreover, the learning function involves, updating/storing the deviation of the air-fuel ratio feedback correction coefficient $\alpha$ from a reference value (target convergence value), as an air-fuel ratio learning correction coefficient $K_L$ (air-fuel ratio learning correction value) for each of several partitioned engine operating regions (that is, learning areas). The basic fuel injection quantity Tp is then corrected with the air-fuel ratio learning correction coefficient $K_L$, so that a base air-fuel ratio obtained without the air-fuel ratio feedback correction coefficient $\alpha$, coincides approximately with the target value, thus enabling a more rapid convergence in the air-fuel ratio feedback control, of the actual air-fuel ratio on the target air-fuel ratio.

That is to say, by incorporating a learning function in the air-fuel ratio feedback control, then the actual air-fuel ratio can be better controlled to close to the target air-fuel ratio, corresponding with good response to correction requirements for the fuel injection quantity which differ for each operating condition.

With the abovementioned conventional air-fuel ratio learning control apparatus however, in order to improve the learning accuracy when updating/setting the learning correction coefficient $K_L$ (in other words, so that learning can be carried out under conditions wherein the air-fuel ratio feedback control is stable), if in a predetermined learning area, the oxygen sensor output exceeds the slice level for a predetermined number of times (for example two times) or more, then the deviation of the air-fuel ratio feedback correction coefficient $\alpha$ from the reference value during the subsequent period wherein the oxygen sensor output exceeds the slice level for a predetermined number of times (at least twice), is used in the computation for the learning correction coefficient $K_L$. As a result, the following problems can arise.

Since the comparison of the oxygen sensor output value with the slice level is made for example for each input of a reference signal generated corresponding to each cylinder piston reference position, then in a region such as a low rotational speed idling region and the like, the number of times the oxygen sensor output exceeds the slice level within a predetermined period will be less than for a high rotational speed region. As a result, the learning opportunity particularly in the idling region is reduced, so that learning is not expedited, and learning accuracy is thus reduced.

Moreover, in the idling region the exhaust flow rate is inherently low. As a result, due to the poor response characteristics of the oxygen sensor in regions of low exhaust flow rates, the rich/lean inversion period is increased, further promoting the beforementioned reduction in learning opportunity.

SUMMARY OF THE INVENTION.

The present invention takes into consideration the above situation, with the object of providing a method and apparatus for controlling air-fuel ratio learning of an internal combustion engine, which can increase learning opportunities while maintaining learning accuracy, even in regions such as the idling region wherein the number of acquisitions of air-fuel ratio feedback correction values within a predetermined period is small, to thereby effect high accuracy learning in all operating regions. Moreover, it is an object of the present invention to achieve this with a simple yet highly accurate method and apparatus.

To achieve the above objectives, the method and apparatus for controlling air-fuel ratio learning of an internal combustion engine according to the present invention includes;

an air-fuel ratio detection step or device for detecting an air-fuel ratio of an engine intake mixture, an air-fuel ratio feedback correction value setting step or device for setting an air-fuel ratio feedback correction value for correcting a basic control quantity for the air-fuel ratio, so that the actual air-fuel ratio detected by the air-fuel ratio detection step or device approaches close to a target air-fuel ratio, an air-fuel ratio learning correction value storage step or device for partitioning an engine operating region into a plurality of operating regions, and rewritably storing in each operating region, air-fuel ratio learning correction values for correcting the basic control quantity for the air-fuel ratio, an air-fuel ratio learning step or device for updating/setting for each operating region, the air-fuel ratio learning correction values stored by the air-fuel ratio learning correction value storage step or device, in a direction such that a deviation of the air-fuel ratio feedback correction value from a reference value is reduced, an air-fuel ratio learning correction value updating/setting step or device for performing updating/setting treatment on air-fuel ratio learning correction values in the air-fuel ratio learning step or device, in accordance with an acquisition condition of the air-fuel ratio feedback correction value, an air-fuel ratio control quantity setting step or device for setting a final air-fuel ratio control quantity based on the basic control quantity for the air-fuel ratio, the air-fuel ratio feedback correction value, and the air-fuel ratio learning correction value corresponding to the operating region, and a drive step or device for drive control of an air-fuel ratio control step or device, based on the air-fuel ratio control quantity set by the air-fuel ratio control quantity setting step or device.

With the present invention incorporating the above construction, the updating/setting treatment of the air-fuel ratio learning correction value is performed by a treatment method which is in accordance with acquisition conditions (the number of acquisitions or the acquisition order, within a predetermined period) of the air-fuel ratio feedback correction value. Therefore, since the larger the number of acquisitions within a predetermined period, the more stable (hence more reliable) the deviation of the air-fuel ratio feedback correction value from the reference value, then when the number of acquisitions is small, the previous air-fuel ratio learning correction value is given importance in obtaining a new air-fuel ratio learning correction value. On the other hand, when the number of acquisitions is large, the current air-fuel ratio learning correction value is given importance in obtaining a new air-fuel ratio learning correction value. Alternatively, since the later the acquisition order, the more stable the deviation of the air-fuel ratio feedback correction value from the reference value, then, the air-fuel ratio feedback correction value of later acquisition order can be made to influence the new air-fuel ratio learning correction values, while the air-fuel ratio feedback correction value of earlier acquisition order can be made to have no influence on the new air-fuel ratio learning correction values. Accordingly, even in the region such as the idling region wherein the number of acquisitions of the air-fuel ratio feedback correction value within a predetermined period is comparatively small, then even if due to this there is a learning error (an error due to insufficient sampling, or due to learning having to be carried out after initiation of air-fuel ratio feedback control when the air-fuel ratio feedback correction value is not yet stable), this error can be kept small. Hence it is possible to expedite the updating/setting control for the air-fuel ratio learning correction value from a condition wherein the number of acquisitions is small. Therefore even in the idling region and the like, learning opportunities similar to those for the high speed region and the like can be provided.

Moreover, since as a result, learning is expedited even in the idling region and the like in a similar manner to in the high speed region and the like, then compared to the conventional air-fuel ratio learning control method and apparatus, the reliability of the air-fuel ratio learning control value in the idling region and the like can be kept high. Moreover, in the high speed region and the like wherein the number of acquisitions of the air-fuel ratio feedback correction value within the predetermined period is large, since the currently obtained air-fuel ratio learning correction value can be given importance in obtaining a new air-fuel ratio learning correction value, then a high accuracy air-fuel ratio learning correction value influenced by the current acquisition result can also be obtained.

As a result of the above, with the present invention, since the air-fuel ratio learning correction value is subjected to updating/setting treatment in accordance with the acquisition conditions (the number of acquisitions or the acquisition order) of the air-fuel ratio feedback correction value within a predetermined period, then even in the region such as the idling region and the like wherein the number of acquisitions of the air-fuel ratio feedback correction value within the predetermined period is comparatively small, the updating/setting control of the air-fuel ratio learning correction value can be expedited from an early stage while suppressing learning error. Therefore even in the idling region and the like, learning opportunities similar to those for the high speed region can be provided. Moreover, since as a result, learning is expedited, then compared to the conventional air-fuel ratio learning control method and apparatus, it is possible for the air-fuel ratio learning control value in the idling region and the like to also have a high reliability.

It will be clear that the scope of the present invention also includes a construction wherein the air-fuel ratio learning correction value updating/setting step or device of the present invention is adopted in the region wherein the acquisition conditions of the air-fuel ratio feedback correction value within the predetermined period are on the comparatively low side (that is to say low rotational speed side), and an updating/setting control for the air-fuel ratio learning correction value similar to the conventional arrangement, which has no relation to the acquisition conditions of the air-fuel ratio feedback correction value within a predetermined period, is adopted in the region wherein the acquisitions conditions of the air-fuel ratio feedback correction value within a predetermined period are high and above a predetermined value. That is to say, a construction wherein updating/setting control is selectively switched depending on the operating region is included in the present invention.

The air-fuel ratio learning correction value updating/setting step or device may includes; in the operating region, updating/setting to a new air-fuel ratio learning correction value based on a currently obtained air-fuel ratio feedback correction value and an air-fuel ratio learning correction value prior to updating/setting, by increasing a weighting on the currently obtained air-fuel ratio feedback correction value, in accordance with an increase in the number of acquisitions of the air-fuel ratio feedback correction value within a predetermined period.

If in this way, the air-fuel ratio learning correction value updating/setting step or device, in the operating region, updates/sets to a new air-fuel ratio learning correction value, based on a currently obtained air-fuel ratio feedback correction value and an air-fuel ratio learning correction value prior to updating/setting, by increasing a weighting of the currently obtained air-fuel ratio feedback correction value, in accordance with an increase in the number of acquisitions of the air-fuel ratio feedback correction value (which may be for example, a central value between a maximum and minimum value of increase/decrease fluctuations of the air-fuel ratio feedback correction value, or an average value of increase/decrease fluctuations of the air-fuel ratio feedback correction value within a single period) within a predetermined period, then the abovementioned operational effects of the present invention can be achieved with a comparatively simple method. More specifically, it is possible to expedite the updating/setting control of the air-fuel ratio learning correction value even from conditions wherein the number of acquisitions of the air-fuel ratio feedback correction value are small. Therefore even in the idling region and the like, learning opportunities similar to those for the high speed region and the like can be provided. Hence since learning is expedited, then compared to the conventional air-fuel ratio learning control method and apparatus, it is possible to also obtain an air-fuel ratio learning correction value in the idling region and the like with a high reliability.

If the currently obtained air-fuel ratio feedback correction value is made an average value of the increase/decrease fluctuations of the currently obtained air-fuel ratio feedback correction value per single period, then compared to the case wherein the central value between the maximum and minimum values of the increase/decrease fluctuations of the air-fuel ratio feedback correction value is used, the abovementioned operational effects of the present invention can be provided with a simple construction and to a higher accuracy.

Moreover, the air-fuel ratio learning correction value updating/setting step or device may include, in the operating region, updating/setting to a new air-fuel ratio learning correction value based on a currently obtained air-fuel ratio feedback correction value and an air-fuel ratio learning correction value prior to updating/setting, by increasing a weighting on the currently obtained air-fuel ratio feedback correction value the later the acquisition order thereof.

If in this way, updating/setting to a new air-fuel ratio learning correction value based on the currently obtained air-fuel ratio feedback correction value and the air-fuel ratio learning correction value prior to updating/setting is carried out by increasing the weighting on the currently obtained air-fuel ratio feedback correction value the later the acquisition order thereof, then since the later the acquisition order the more stable the air-fuel ratio feedback correction value, then the new air-fuel ratio feedback correction values of later acquisition order can be made to have more influence on updating/setting of the new air-fuel ratio learning correction values, while the air-fuel ratio feedback correction values of earlier acquisition order where reliability is low can be made to have no influence on the new air-fuel ratio learning correction values. Therefore, even in the region such as the idling region and the like wherein the number of acquisitions of the air-fuel ratio feedback correction value within the predetermined period is comparatively small, learning error due to the small number of acquisitions can be kept small. Hence, it is possible to expedite the updating/setting control for the air-fuel ratio learning correction value from the condition wherein the number of acquisitions is small. Therefore even in the idling region and the like, learning opportunities similar to those for the high speed region and the like can be provided.

In this case, the air-fuel ratio learning correction value updating/setting step or device may include; in the operating region, updating/setting to a new air-fuel ratio learning correction value based on an average value of, currently obtained air-fuel ratio feedback correction values which have been increasingly weighted the later the acquisition order thereof, and the air-fuel ratio learning correction value prior to updating/setting.

Moreover, the air-fuel ratio learning correction value updating/setting step or device may involve; in the operating region, updating/setting to a new air-fuel ratio learning correction value by subjecting an averaged value of currently obtained air-fuel ratio feedback correction values which have been increasingly weighted the later the acquisition order thereof, and the air-fuel ratio learning correction value prior to updating/setting, to an averaging treatment wherein the weighting on the averaged value is increased in accordance with an increase in the number of acquisitions of the air-fuel ratio feedback correction value within a predetermined period.

Furthermore, the currently obtained air-fuel ratio feedback correction value may be an average value of the increase/decrease fluctuations of the currently obtained air-fuel ratio feedback correction value per single period.

In this case, the abovementioned operational effects of the present invention can be provided with a simple construction and to a higher accuracy.

Other objects and aspects of the present invention will become apparent from the following description of embodiments given in conjunction with the appended drawings.

DETAILED DESCRIPTION OF THE PREFERRED EMBODIMENTS

As follows is a description of embodiments of the present invention with reference to the drawings.

Figure 1:
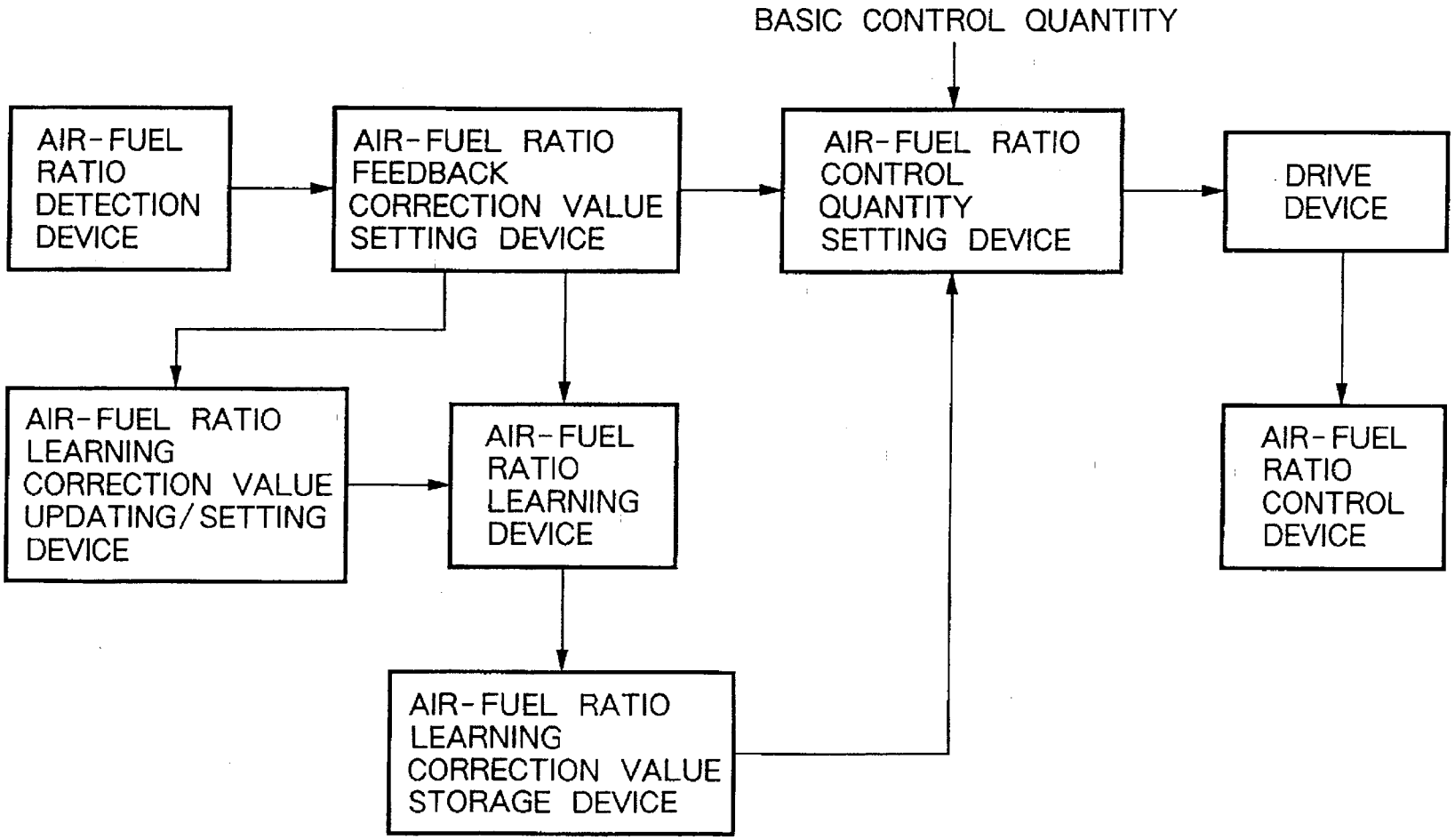
FIG. 1 is a block diagram of the present invention.
Figure 2:
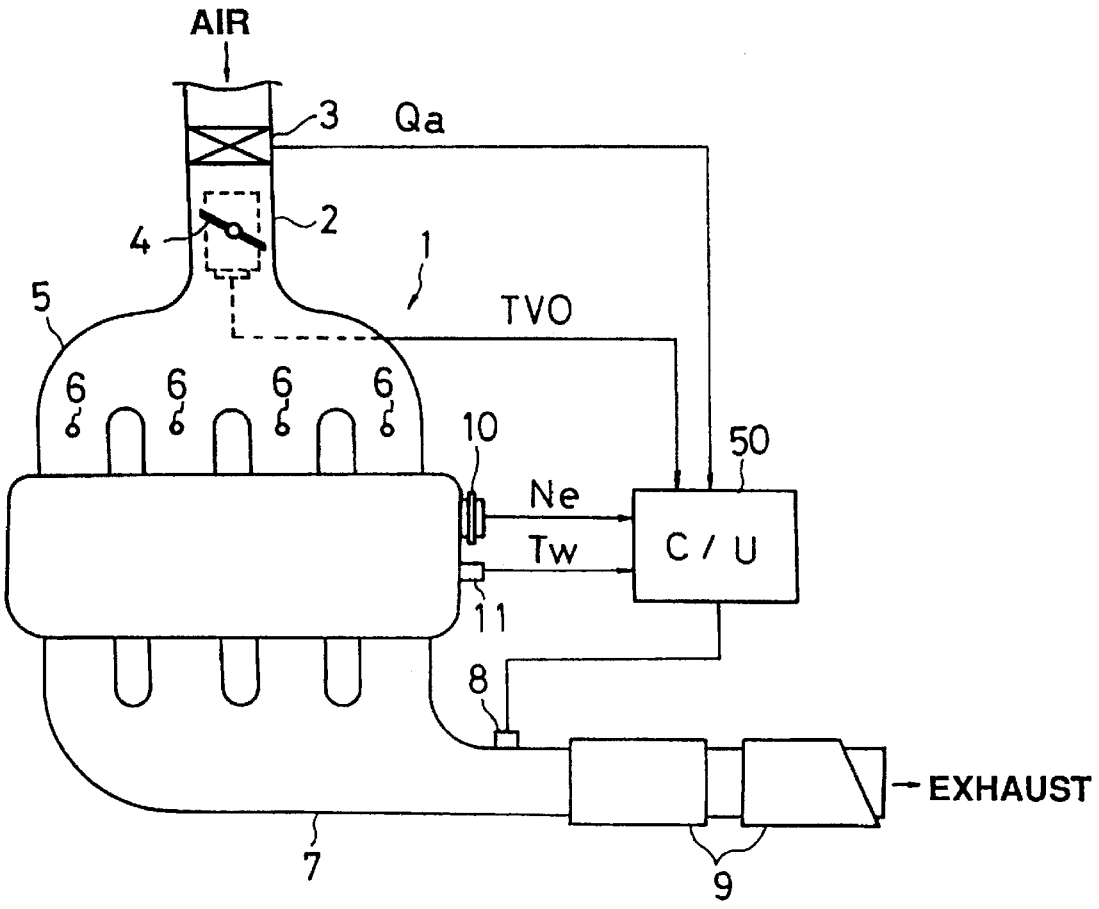
FIG. 2 is a schematic diagram showing the overall structure of a first embodiment according to the present invention.

In the schematic diagram of FIG. 2 showing the overall structure of a first embodiment of the present invention, there is provided an air flow meter 3 for detecting an intake air quantity Q of intake air drawn into an intake air passage 2 of an engine 1 by way of an air cleaner (not shown), and a throttle valve 4 connected to an accelerator pedal, for controlling the intake air quantity Q. Solenoid type fuel injection valves 6 for injecting fuel to each cylinder, are provided in a manifold section 5, downstream of the throttle valve 4.

The fuel injection valves 6 are driven open in response to an injection pulse signal provided by a control unit 50 (to be described later), to thereby inject fuel pressurized by a fuel pump (not shown), and controlled to a predetermined pressure by means of a pressure regulator. That is to say, the fuel injection valves 6 correspond to an air-fuel ratio control device for controlling an air-fuel ratio control quantity (for example fuel injection quantity or intake air flow quantity).

An oxygen sensor 8 is provided in an exhaust passage 7 of the engine 1, as an air-fuel ratio detection device for detecting air-fuel ratio by detecting the oxygen concentration in the exhaust at a combined portion of the manifold. Moreover a three-way catalytic converter 9 is provided downstream of the oxygen sensor 8, as an exhaust gas purification catalytic converter which realizes a maximum oxidization effect on the CO, HC, and a maximum reduction effect on the NOx in the exhaust near the stoichiometric air-fuel ratio, to thus purify the exhaust gases.

Also provided is a crank angle sensor 10 for detecting a unit crank angle signal from a crank shaft or a cam shaft. The control unit 50 detects the engine rotational speed Ne by counting the unit crank angle signals output from the crank angle sensor 10 over a fixed period, or by measuring the frequency of a reference crank angle signal. The crank angle sensor 10 also generates a reference signal corresponding to each cylinder piston reference position for each predetermined crank angle (for example for each 120° for a four cycle six cylinder engine).

A water temperature sensor 11 is provided for detecting a cooling water temperature Tw of the engine 1.

The control unit 50 incorporates components such as a CPU, ROM, RAM, A/D converter and input/output interface, whereby the functions of the air-fuel ratio feedback correction value setting device, the air-fuel ratio learning correction value storage device, the air-fuel ratio learning device, the air-fuel ratio learning correction value updating/setting device, the air-fuel ratio control quantity setting device, and the drive device, according to the present invention are realized by software stored therein. The control unit 50 computes fuel quantities from the fuel injection valves 6 corresponding to target air-fuel ratios, based on values detected by the various sensors, according to the following method, and outputs to the fuel injection valves 6 injection pulse signals with pulse widths corresponding to the fuel quantities.

More specifically, a basic fuel injection pulse width (corresponding to a basic fuel injection quantity) Tp ($Tp=k\times Q/Ne$, where k is a constant) is set from the intake air quantity Q detected by the air flow meter 3 and the engine rotational speed Ne obtained by counting the pulse signals from the crank angle sensor 10 over a fixed period, so as to obtain a stoichiometric air-fuel ratio. Furthermore, various types of correction coefficients COEF corresponding to engine operating conditions such as engine temperature, as well as an air-fuel ratio feedback correction coefficient $\alpha$, a learning correction coefficient $K_L$, and a correction portion Ts for correcting a change in effective opening time of the solenoid fuel injection valve due to battery voltage, are respectively obtained to correct/compute the basic fuel injection pulse width Tp, and set a final fuel injection pulse width Ti ($=Tp\cdot COEF\cdot\alpha\cdot K_L+Ts$) (corresponding to the fuel injection quantity after final correction) so that the actual air-fuel ratio becomes the target air-fuel ratio. The various types of correction coefficients COEF are computed for example from an equation such as $COEF=1+K_{MR}+K_{TW}+K_{AS}+K_{AI}+\ldots$, where $K_{MR}$ is an air-fuel ratio correction coefficient, $K_{TW}$ is a water temperature increase amount correction coefficient, $K_{AS}$ is a start-up and post start-up increase amount correction coefficient, and $K_{AI}$ is a post idle increase amount correction coefficient.

The air-fuel ratio feedback correction coefficient $\alpha$ is increased/decreased by proportional or integral control and the like, based on a rich/lean inversion signal from the oxygen sensor 8 provided in the engine exhaust system, thereby enabling control of the air-fuel ratio of the engine intake air mixture to the target air-fuel ratio (stoichiometric air-fuel ratio).

Moreover, by determining a learning correction coefficient $K_L$, through learning for each area of each previously determined engine operating condition, the deviation of the air-fuel ratio feedback correction coefficient $\alpha$ during air-fuel ratio feedback control from the reference value then in the beforementioned fuel injection quantity computation the basic fuel injection quantity Tp is corrected by the learning correction coefficient $K_L$, to obtain the target air-fuel ratio from the fuel injection quantity Ti computed without correction from the air-fuel ratio feedback correction coefficient $\alpha$ (when $\alpha=1.0$). Hence air-fuel ratio control accuracy is improved with good response from prior to the time where the air-fuel ratio feedback correction coefficient $\alpha$ can be obtained (for example during changes in the operating conditions).

Figure 3:
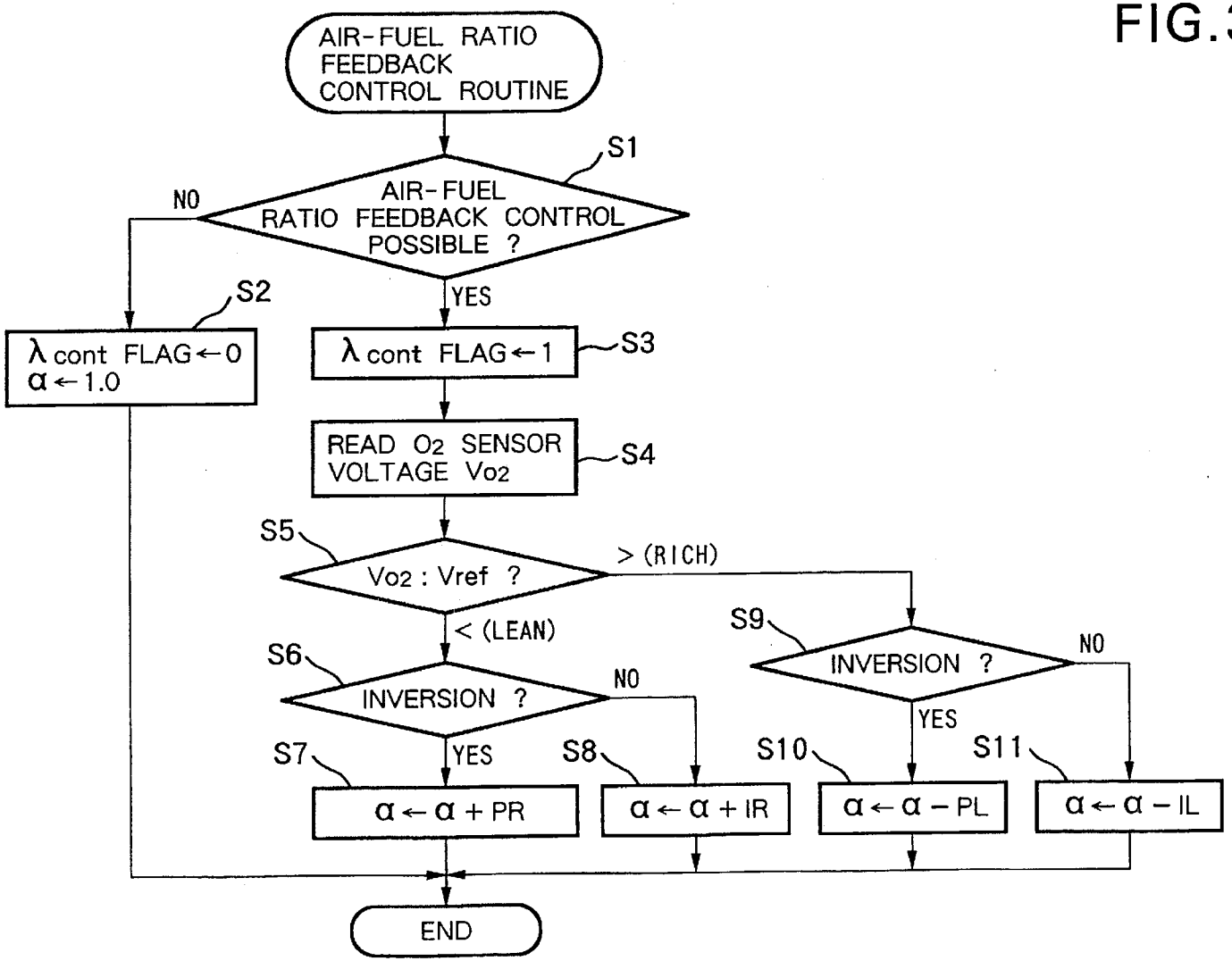
FIG. 3 is a flow chart for explaining an air-fuel ratio feedback control for the first embodiment.

As follows is a description of air-fuel ratio feedback control carried out by the control unit 50 as an air-fuel ratio feedback correction value setting device, according to the flow chart of FIG. 3 Air-fuel ratio feedback control is carried out for each reference signal generated from the crank angle sensor 10, or for a similar time period, to thereby set the air-fuel ratio feedback correction coefficient $\alpha$. This is then used in computing the fuel injection quantity Ti.

More specifically, in step 1 (with "step" denoted by S in the figures), it is judged if operating conditions are such that air-fuel ratio feedback control is possible. If not, control proceeds to step 2 where a $\lambda$ cont flag is set to 0, the air-fuel ratio feedback correction coefficient $\alpha$ is set to 1.0, and the routine terminated.

On the other hand, if air-fuel ratio feedback control is possible, control proceeds to step 3 where the $\lambda$ cont flag is set to 1, and control then proceeds to step 4. Operating conditions wherein air-fuel ratio feedback control is not possible are judged for example as being at the time of start-up, low water temperature, low oxygen sensor 8 activation, an oxygen sensor 8 fault, high load, and when lean control is not being carried out.

In step 4, an output voltage Vo2 of the oxygen sensor 8 is read. Then in the next step 5, this is compared with a slice level voltage Vref to determine the richness/leanness of the air-fuel ratio.

When the air-fuel ratio is lean (Vo2<Vref), control proceeds from step 5 on to step 6 where it is judged if this is a rich to lean inversion time (ie. inversion has just occurred). In the case of an inversion, control proceeds to step 7.

In step 7, the air-fuel ratio feedback correction coefficient $\alpha$ is increased from its previous value by a predetermined proportional constant amount PR, to thus rapidly correct the air-fuel ratio in the rich direction. At times other than the inversion time, control proceeds to step 8 where air-fuel ratio feedback correction coefficient $\alpha$ is increased from its previous value by an integral constant amount IR, to thus increase the air-fuel ratio feedback correction coefficient $\alpha$ with a constant inclination.

When the air-fuel ratio is rich (Vo2>Vref), control proceeds from step 5 on to step 9 where it is judged if this is a lean to rich inversion time (ie. inversion has just occurred). In the case of an inversion, control proceeds to step 10.

In step 10, the air-fuel ratio feedback correction coefficient $\alpha$ is reduced from its previous value by a predetermined proportional constant amount PL, to thus rapidly correct the air-fuel ratio in the lean direction. At times other than the inversion time, control proceeds to step 11 where the air-fuel ratio feedback correction coefficient $\alpha$ is reduced from its previous value by a predetermined integral constant amount IL, to thus decrease the air-fuel ratio feedback correction coefficient $\alpha$ with a constant inclination.

The above describes the air-fuel ratio feedback control.

Figure 4:
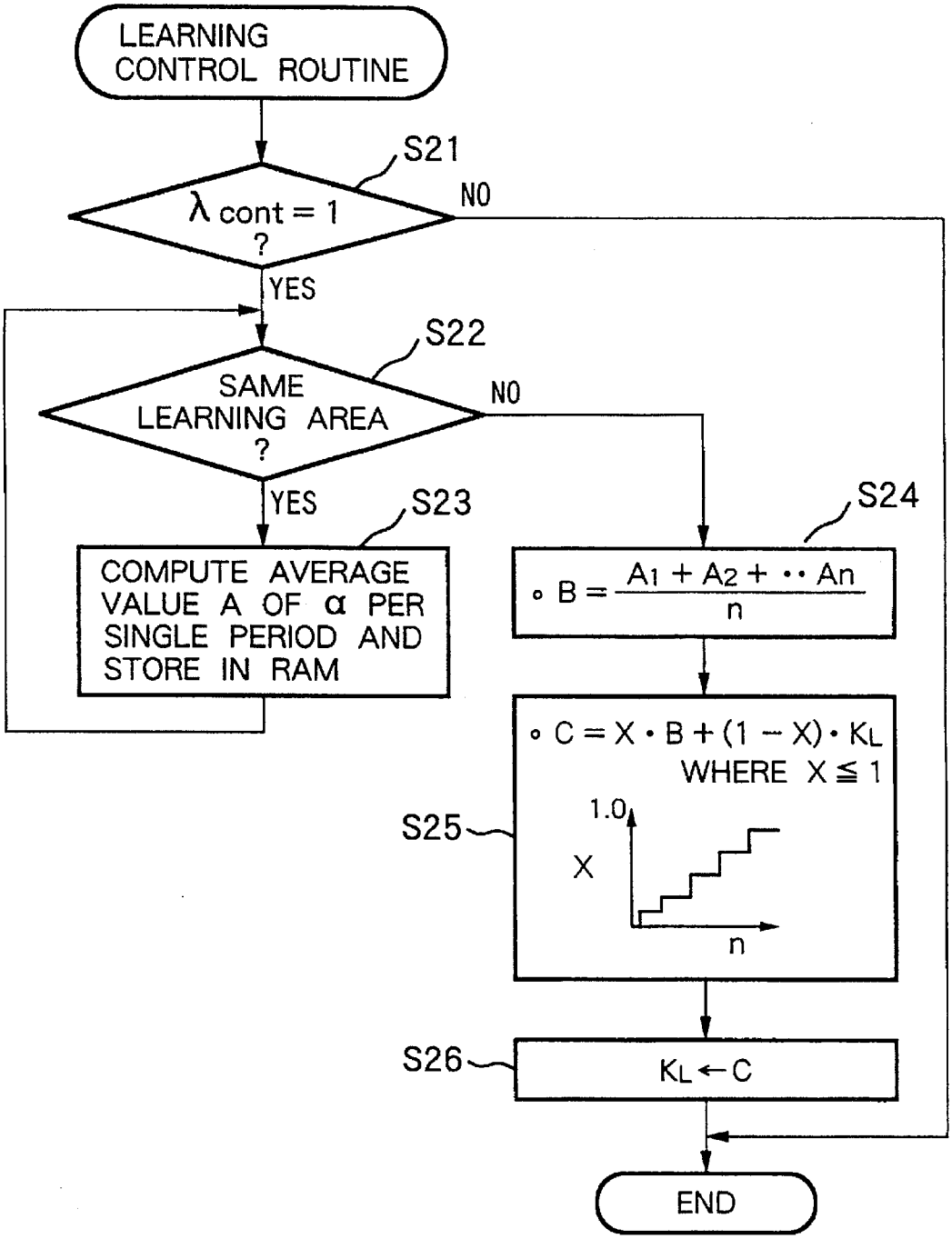
FIG. 4 is a flow chart for explaining an air-fuel ratio learning control for the first embodiment.
Figure 7:
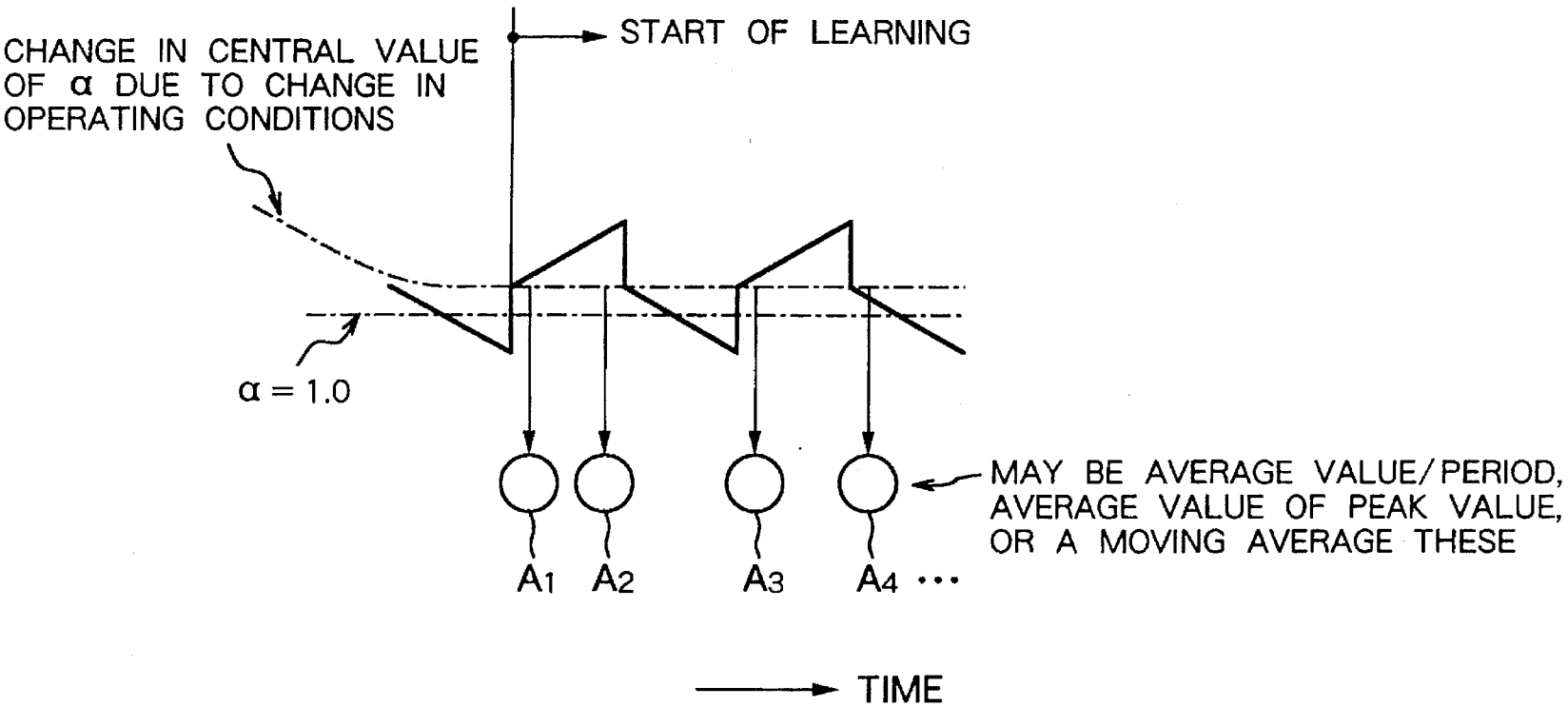
FIG. 7 is a time chart for explaining an air-fuel ratio feedback correction coefficient $\alpha$ and a deviation A.

Next is a description with reference to FIG. 7, of air-fuel ratio learning control carried out by the control unit 50 according to the flow chart of FIG. 4.

In step 21, it is judged whether or not the $\lambda$ cont flag is 1. If zero, the routine is terminated. This is so that learning cannot be carried out when air-fuel ratio feedback control is stopped.

In step 22, it is judged if predetermined learning prerequisites have materialized. If so, control proceeds to step 23 while if not, control proceeds to step 24. Here the predetermined learning prerequisites are for example, the engine operating conditions region (learning area) being determined from the engine rotational speed Ne and the basic fuel injection quantity Tp with the cooling water temperature Tw being equal to or above a predetermined value, and the number of lean/rich inversions of the oxygen sensor 8 in the same learning area being carried out equal to or more than a predetermined number of times (for example two times). If such conditions are not met, the routine is terminated.

When during air-fuel ratio feedback control, with the predetermined learning prerequisites materialized, a learning area for learning is determined, control proceeds to step 23 where average values A per predetermined period (a single period in this case) of the air-fuel ratio feedback correction coefficient $\alpha$ are respectively computed for example by a moving average method (see FIG. 7). These are stored in the RAM in the order of computation as A1, A2, . . . until the judgment of step 22 is a NO. When the learning correction coefficient $K_L$ is used for the fuel injection quantity Ti ($Ti=Tp \cdot COEF \cdot (\alpha+K_L)+Ts$), the subsequent treatment can be carried out by obtaining the respective deviations of the average values A1, A2, . . . from a reference value (for example 1.0), and succeeedingly storing the deviations. Now the average values A1, A2, . . . can be the average values (or the deviations of the average values from a reference value) of the air-fuel ratio feedback correction coefficient a peak values (that is to say the values immediately prior to addition of the proportional portion $P_R$ or subtraction of the $P_L$) from inversion of the air-fuel ratio feedback correction coefficient $\alpha$ in the increase or decrease direction until the subsequent inversion.

In step 22, if the judgment is NO, control proceeds to step 24 to carry out update treatment of the learning correction coefficient $K_L$.

In step 24, an arithmetical mean value B of the average values A1, A2, . . . is obtained.

In step 25, the learning correction coefficient $K_L$ (with initial value 1) stored up until the previous time in a map of the RAM corresponding to the learning area prior to the judgment of NO in step 22 is read, and the learning correction coefficient $K_L$ and the arithmetical mean value B are weighted averaged to obtain a weighted average value C. The weighting proportion X (weighting coefficient) at this time is changed in accordance with the number of acquisitions of the average values A. That is to say, the larger the number of acquisitions of the average values A, (in other words the more the number of rich/lean inversions in the output from the oxygen sensor 8), the larger the setting becomes for the weighting proportion X (weighting coefficient) for the currently obtained arithmetical mean value B side (X can be appropriately set in any manner, for example in a stepwise, linear, or curvilinear manner, so as to increase with an increase in n). This is because the reliability of the arithmetical mean value B increases with the number of acquisitions.

In step 26, the data in the RAM for the map of the same learning area, is rewritten with the weighted average value C as a new learning correction coefficient $K_L$.

$$K_L \leftarrow C$$

In this way, a new learning correction coefficient $K_L$ is thus obtained by subjecting the previous learning correction coefficient $K_L$ and the weighted average value C for the currently obtained air-fuel ratio feedback correction coefficient $\alpha$ to a weighted average treatment in accordance with the acquisitions conditions (number of acquisitions) of the air-fuel ratio feedback correction coefficient $\alpha$. Therefore even in the region such as the idling region, where the number of acquisitions of the average value A per predetermined period is small (where the number of rich/lean inversions in the output of the oxygen sensor 8 is small), by setting the weighting coefficient for the currently obtained weighted average value C side to be small, then even if the currently obtained weighted average value C includes some amount of error due to the number of acquisitions of the average value A being small, the updating/setting control of the learning correction coefficient can be expedited without any significant influence being exerted on the new learning correction coefficient $K_L$ (that is to say, learning accuracy is not compromised, even if learning is expedited from the condition wherein the number of acquisitions of the average value A is small). Hence even in the idling region and the like, learning opportunities similar to those for the high speed region and the like can be provided. Moreover, since as a result learning is expedited, then the value for the learning correction coefficient $K_L$ can also be obtained with a higher reliability compared to with the conventional arrangement. On the other hand, in the region wherein the number of acquisitions of the average value A per predetermined period is large, since the weighting coefficient for the currently obtained weighted average value C side is set to be large in accordance with the number of acquisitions, then a highly accurate learning correction coefficient $K_L$ reflecting the current acquisition results can be obtained.

The flow chart of FIG. 4 is for one example. However, the basic concept of the present invention according to the first embodiment is not limited to that represented by the flow chart of FIG. 4, provided it includes the idea that a new learning correction coefficient $K_L$ is obtained by subjecting the previous learning correction coefficient $K_L$ and the currently obtained air-fuel ratio feedback correction coefficient $\alpha$ to a weighting treatment in accordance with the acquisition conditions (number of acquisitions) of the air-fuel ratio feedback correction coefficient $\alpha$, so that learning can be started and expedited even from conditions wherein the number of acquisitions of the air-fuel ratio feedback correction coefficient $\alpha$ per predetermined period is small.

As follows is a description of a second embodiment according to the present invention.

The second embodiment differs from the first embodiment only in the flow chart of FIG. 5 for the air-fuel ratio learning control, and hence only this part will be explained.

In step 31, it is judged whether or not the $\lambda$ cont flag is 1. If zero, the routine is terminated. This is so that learning cannot be carried out when air-fuel ratio feedback control is stopped.

In step 32, it is judged if predetermined learning prerequisites have materialized. If so, control proceeds to step 33 while if not, control proceeds to step 34. Here the predetermined learning prerequisites are for example, steady operating conditions with the engine operating conditions region (learning area) being determined from the engine rotational speed Ne and the basic fuel injection quantity Tp with the cooling water temperature Tw equal to or above a predetermined value, and the number of lean/rich inversions of the oxygen sensor 8 in the same learning area being carried out equal to or more than a predetermined number of times (for example two times). If such conditions are not met, the routine is terminated.

That is to say, when during air-fuel ratio feedback control with the predetermined learning prerequisites materialized, a learning area for learning is determined, control proceeds to step 33 where an average value of the air-fuel ratio feedback correction coefficient $\alpha$ per single period, is computed for example by a moving average method to obtain the average values A of the air-fuel ratio feedback correction coefficient $\alpha$. These are stored in the RAM in the order of computation as A1, A2, . . . until the judgment of step 32 is a NO. When the learning correction coefficient $K_L$ is used for the fuel injection quantity Ti ($Ti=Tp \cdot COEF \cdot (\alpha+K_L)+Ts$), the subsequent treatment can be carded out by obtaining respective deviations of the average values A1, A2, . . . from a reference value (for example 1.0), and successfully storing the deviations. Now the average values A1, A2, . . . can be the average values (or the deviations of the average values from a reference value) of the air-fuel ratio feedback correction coefficient α peak values (that is to say the values immediately prior to addition of the proportional portion $P_R$ or subtraction of the $P_L$) from inversion of the air-fuel ratio feedback correction coefficient α from the increase or decrease direction until the subsequent inversion.

In step 32, if the judgment is NO, control proceeds to step 34 to carry out update treatment of the learning correction coefficient $K_L$.

In step 34, the weighted average value D of the average values A1, A2, . . . is computed. The weighting proportion Yn (weighting coefficient) at this time is gradually incremented in accordance with the acquisition order of the average values A1, A2, . . . (with increasing suffix number). This is because the air-fuel ratio feedback correction coefficient α becomes more stable the later the acquisition order of the average values A1, A2, and the reliability of the value is thus higher.

In step 35, the learning correction coefficient $K_L$ (with initial value 1) stored up until the previous time in a map of the RAM corresponding to the learning area prior to the judgment of NO in step 32 is read, and an arithmetical mean value E of the learning correction coefficient $K_L$ and the weighted average value D obtained.

In step 36, the data in the RAM for the map of the same learning area, is rewritten with the arithmetical mean value E as a new learning correction coefficient $K_L$.

$$K_L \leftarrow E$$

In this way, a new learning correction coefficient $K_L$ is thus obtained by changing the weighting according to the acquisition order of the average values A1, A2, . . . to obtain the average value D, and subjecting the previous learning correction coefficient $K_L$ and the currently obtained average value D to an arithmetical mean treatment. Therefore in the region such as the idling region and the like, where the number of acquisitions of the average value A per predetermined period is small (where the number of rich/lean inversions in the output of the oxygen sensor 8 is small), the influence given to the new learning correction coefficient $K_L$ with lower reliability deviations can be minimised, and learning control can be expedited. Hence in the idling region, learning opportunities similar to those for the high speed region can be provided, and the learning accuracy can thus be kept high. Moreover, since the learning is expedited by increasing the learning opportunities, then the value for the learning correction coefficient $K_L$ can have a higher reliability compared to with the conventional arrangement. On the other hand, in the region wherein the number of acquisitions of the average value A per predetermined period is large, then a highly accurate (reflecting the current learning results) learning correction coefficient $K_L$ in accordance with the number of acquisitions can be obtained.

Figure 5:
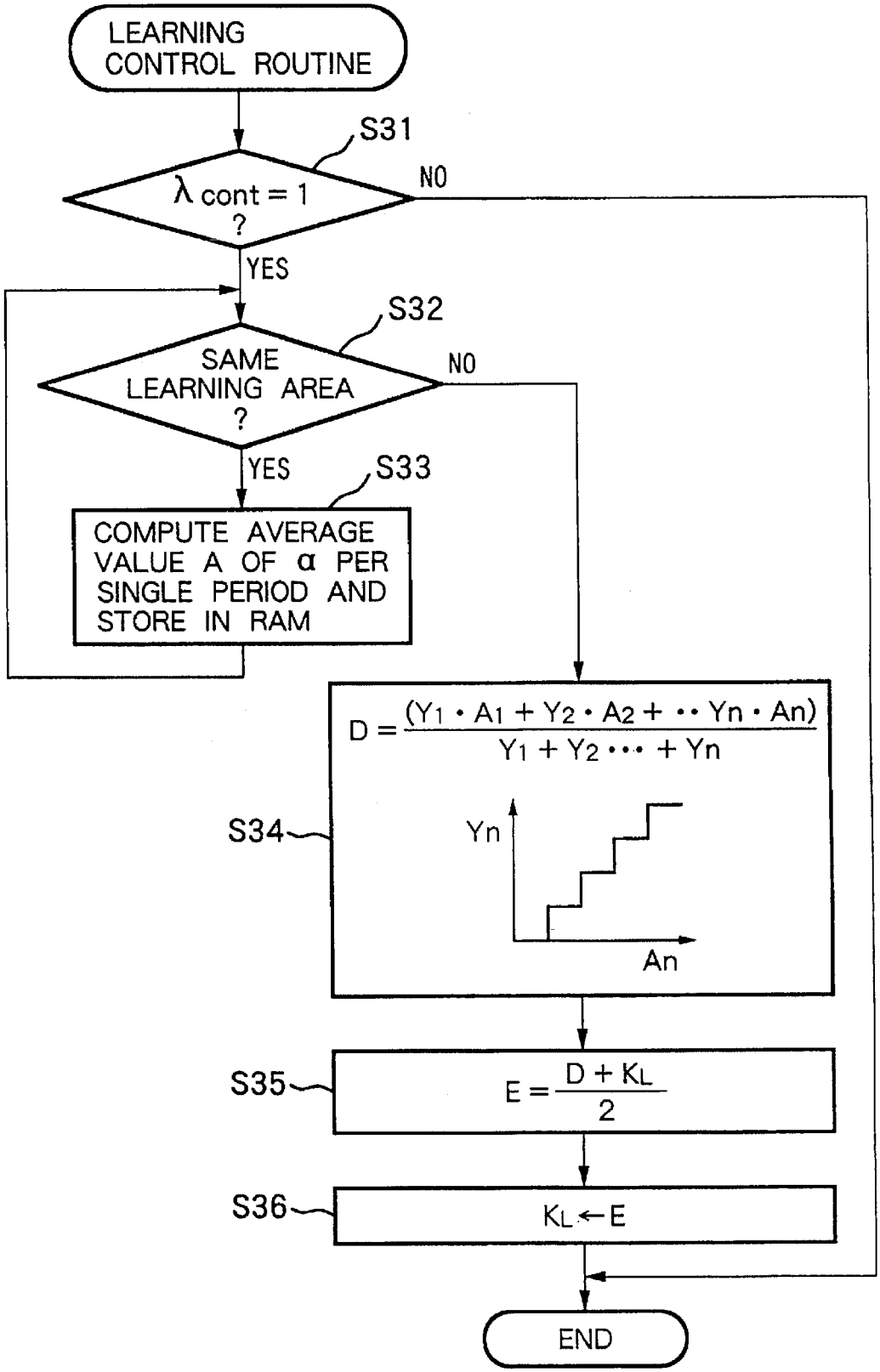
FIG. 5 is a flow chart for explaining an air-fuel ratio learning control for a second embodiment.

The flow chart of FIG. 5 also is merely for one example, and the present invention is not limited to this provided it includes the concepts of the present invention according to the second embodiment.

A third embodiment of the present invention will now be described.

With the third embodiment, the air-fuel ratio learning control method differs from that of the first and second embodiment. However, since the flow chart of FIG. 6 for the air-fuel ratio learning control of the third embodiment only differs from the flow chart of FIG. 5 for the air-fuel ratio learning control of the second embodiment, from step 35 on, then the relevant parts only will be described.

That is to say, in step 35A, the learning correction coefficient $K_L$ (with initial value of 1) stored up until the previous time in a map of the RAM corresponding to the learning area prior to judgment of NO in step 32 is retrieved and read, and a weighted average value F of the previous learning correction coefficient $K_L$ and the weighted average value D obtained in step 34 obtained. The weighting proportion X (weighting coefficient) at this time is changed as explained for step 25, in accordance with the number of acquisitions of the average values A. This is because the reliability of the weighted average value D increases with the number of acquisitions.

In step 36A, the data in the RAM for the map of the same learning area, is rewritten with the weighted average value F obtained in step 35A as a new learning correction coefficient $K_L$.

$$K_L \leftarrow F$$

In this way, a new learning correction coefficient $K_L$ is obtained by changing the weighting according to the acquisition order of the average values A1, A2, . . . to obtain the weighted average value D, and again subjecting the previous learning correction coefficient $K_L$ and the currently obtained weighted average value D to a weighted average treatment. Therefore, in the region such as the idling region and the like, where the number of acquisitions of the average value A per predetermined period is small (where the number of rich/lean inversions in the output of the oxygen sensor 8 is small), learning control can be expedited under conditions wherein the influence given to the new learning correction coefficient $K_L$ with the average values A considered to have a comparatively low reliability (in other words, is obtained in a short period after commencing learning) is less than for the second embodiment. Hence in the idling region, if learning opportunities similar to those for the high speed region are provided, the learning accuracy can thus be kept higher than for the second embodiment. Moreover, since the learning can be expedited by increasing the learning opportunities in the idling region and the like, then the value for the learning correction coefficient $K_L$ for the idling region and the like, can have a higher reliability compared to with the conventional air-fuel ratio learning control method and apparatus. On the other hand, in the region wherein the number of acquisitions of the average value A per predetermined period is large, then a highly accurate (reflecting the current learning results) learning correction coefficient $K_L$ in accordance with the number of acquisitions can be obtained.

Figure 6:
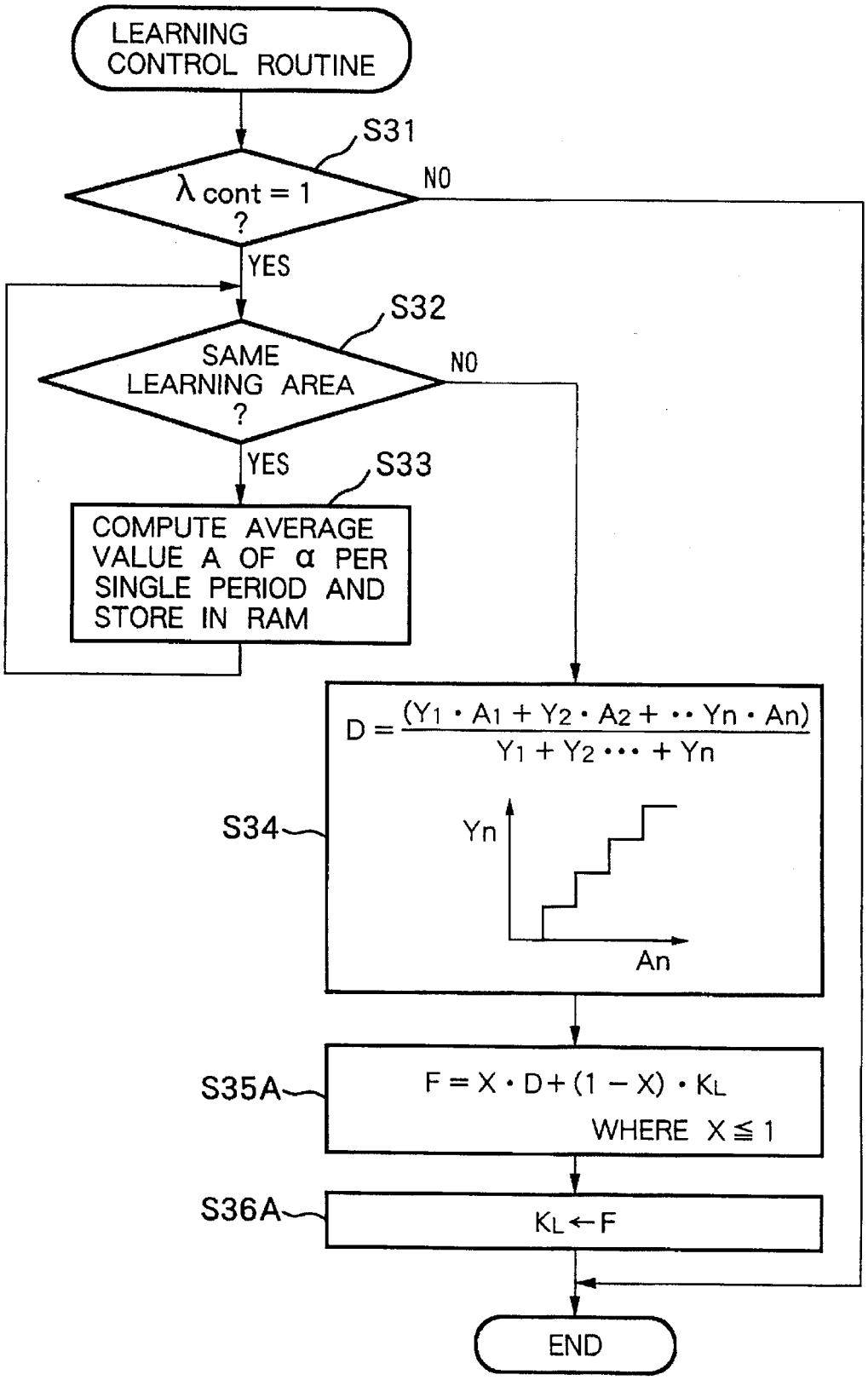
FIG. 6 is a flow chart for explaining an air-fuel ratio learning control for a third embodiment.

The flow chart of FIG. 6 also is merely for one example, and the present invention is not limited to this provided it includes the concepts of the present invention according to the third embodiment.

With the abovementioned various embodiments, the explanation has been in relation to an air-fuel ratio feedback control and learning control using a comparatively low cost oxygen sensor 8. However the invention is also applicable to the case wherein an air-fuel ratio sensor is used which can linearly detect the air-fuel ratio. Furthermore, the explanation has been in relation to use of the fuel injection quantity as the control quantity for controlling the air-fuel ratio. However the invention is not limited to this and is also applicable to the case wherein the intake air flow quantity Q controlled by means of a flow control valve and the like is made the control quantity. Moreover, for the abovementioned respective averaging treatments, treatments other than those of the embodiments may be used provided they achieve the objectives. Furthermore, with the abovementioned respective embodiments, the equation wherein the basic fuel injection pulse width Tp is multiplied by the air-fuel ratio learning correction coefficient $K_L$ ($Ti=Tp \cdot COEF \cdot \alpha \cdot K_L + Ts$), has been described as a representative equation. However the invention is also applicable to the case wherein $K_L$ is made a learning value for the deviation of the average value of the air-fuel ratio feedback correction coefficient $\alpha$ from the reference value (1.0), and Ti is computed from $Ti=Tp \cdot COEF \cdot (\alpha+K_L)+Ts$.

We claim:

1. A method of controlling air-fuel ratio learning of an internal combustion engine said method comprising;

an air-fuel ratio detection step for detecting an air-fuel ratio of an engine intake mixture, an air-fuel ratio feedback correction value setting step for setting an air-fuel ratio feedback correction value for correcting a basic control quantity for the air-fuel ratio, so that the actual air-fuel ratio detected by said air-fuel ratio detection step approaches close to a target air-fuel ratio, an air-fuel ratio learning correction value storage step for partitioning an engine operating region into a plurality of operating regions, and rewritably storing in each operating region, air-fuel ratio learning correction values for correcting said basic control quantity for the air-fuel ratio, an air-fuel ratio learning step for updating/setting for each operating region, air-fuel ratio learning correction values stored by said air-fuel ratio learning correction value storage step, in a direction such that a deviation of the air-fuel ratio feedback correction value from a reference value is reduced, an air-fuel ratio learning correction value updating/setting step for performing updating/setting treatment on air-fuel ratio learning correction values in said air-fuel ratio learning step, in accordance with an acquisition condition of the air-fuel ratio feedback correction value, an air-fuel ratio control quantity setting step for setting a final air-fuel ratio control quantity based on said basic control quantity for the air-fuel ratio, said air-fuel ratio feedback correction value, and said air-fuel ratio learning correction value corresponding to the operating region, and a drive step for drive control of an air-fuel ratio control step, based on the air-fuel ratio control quantity set by said air-fuel ratio control quantity setting step.

2. A method of controlling air-fuel ratio learning of an internal combustion engine according to claim 1, wherein said air-fuel ratio learning correction value updating/setting step carries out; in said operating region, updating/setting to a new air-fuel ratio learning correction value based on a currently obtained air-fuel ratio feedback correction value and an air-fuel ratio learning correction value prior to updating/setting, by increasing a weighting on the currently obtained air-fuel ratio feedback correction value, in accordance with an increase in the number of acquisitions of the air-fuel ratio feedback correction value within a predetermined period.

3. A method of controlling air-fuel ratio learning of an internal combustion engine according to claim 2, wherein said currently obtained air-fuel ratio feedback correction value is an average value of the increase/decrease fluctuations of the currently obtained air-fuel ratio feedback correction value per single period.

4. A method of controlling air-fuel ratio learning of an internal combustion engine according to claim 1, wherein said air-fuel ratio learning correction value updating/setting step carries out, in said operating region, updating/setting to a new air-fuel ratio learning correction value based on a currently obtained air-fuel ratio feedback correction value and an air-fuel ratio learning correction value prior to updating/setting, by increasing a weighting on the currently obtained air-fuel ratio feedback correction value the later the acquisition order thereof.

5. A method of controlling air-fuel ratio learning of an internal combustion engine according to claim 4, wherein said currently obtained air-fuel ratio feedback correction value is an average value of the increase/decrease fluctuations of the currently obtained air-fuel ratio feedback correction value per single period.

6. A method of controlling air-fuel ratio learning of an internal combustion engine according to claim 4, wherein said air-fuel ratio learning correction value updating/setting step carries out, in said operating region, updating/setting to a new air-fuel ratio learning correction value based on an average value of, currently obtained air-fuel ratio feedback correction values which have been increasingly weighted the later the acquisition order thereof, and the air-fuel ratio learning correction value prior to updating/setting.

7. A method of controlling air-fuel ratio learning of an internal combustion engine according to claim 4, wherein said air-fuel ratio learning correction value updating/setting step carries out, in said operating region, updating/setting to a new air-fuel ratio learning correction value by subjecting an average value of currently obtained air-fuel ratio feedback correction values which have been increasingly weighted the later the acquisition order thereof, and the air-fuel ratio learning correction value prior to updating/setting, to an averaging treatment wherein the weighting on said averaged value is increased in accordance with an increase in the number of acquisitions of the air-fuel ratio feedback correction value within a predetermined period.

8. An apparatus for controlling air-fuel ratio learning of an internal combustion engine said apparatus comprising;

air-fuel ratio detection means for detecting an air-fuel ratio of an engine intake mixture, air-fuel ratio feedback correction value setting means for setting an air-fuel ratio feedback correction value for correcting a basic control quantity for the air-fuel ratio, so that the actual air-fuel ratio detected by said air-fuel ratio detection means approaches close to a target air-fuel ratio, air-fuel ratio learning correction value storage means for partitioning an engine operating region into a plurality of operating regions, and rewritably storing in each operating region, air-fuel ratio learning correction values for correcting said basic control quantity for the air-fuel ratio, air-fuel ratio learning means for updating/setting for each operating region, air-fuel ratio learning correction values stored by said air-fuel ratio learning correction value storage means, in a direction such that a deviation of the air-fuel ratio feedback correction value from a reference value is reduced, air-fuel ratio learning correction value updating/setting means for performing updating/setting treatment on air-fuel ratio learning correction values in said air-fuel ratio learning means, in accordance with an acquisition condition of the air-fuel ratio feedback correction value, air-fuel ratio control quantity setting means for setting a final air-fuel ratio control quantity based on said basic control quantity for the air-fuel ratio, said air-fuel ratio feedback correction value, and said air-fuel ratio learning correction value corresponding to the operating region, and drive means for drive control of an air-fuel ratio control means, based on the air-fuel ratio control quantity set by said air-fuel ratio control quantity setting means.

9. An apparatus for controlling air-fuel ratio learning of an internal combustion engine according to claim 8, wherein said air-fuel ratio learning correction value updating/setting means carries out in said operating region, updating/setting to a new air-fuel ratio learning correction value based on a currently obtained air-fuel ratio feedback correction value and an air-fuel ratio learning correction value prior to updating/setting, by increasing a weighting on the currently obtained air-fuel ratio feedback correction value, in accordance with an increase in the number of acquisitions of the air-fuel ratio feedback correction value within a predetermined period.

10. An apparatus for controlling air-fuel ratio learning of an internal combustion engine according to claim 9, wherein said currently obtained air-fuel ratio feedback correction value is an average value of the increase/decrease fluctuations of the currently obtained air-fuel ratio feedback correction value per single period.

11. An apparatus for controlling air-fuel ratio learning of an internal combustion engine according to claim 8, wherein said air-fuel ratio learning correction value updating/setting means carries out, in said operating region, updating/setting to a new air-fuel ratio learning correction value based on a currently obtained air-fuel ratio feedback correction value and an air-fuel ratio learning correction value prior to updating/setting, by increasing a weighting on the currently obtained air-fuel ratio feedback correction value the later the acquisition order thereof.

12. An apparatus for controlling air-fuel ratio learning of an internal combustion engine according to claim 11, wherein said currently obtained air-fuel ratio feedback correction value is the average value of the increase/decrease fluctuations of the currently obtained air-fuel ratio feedback correction value per single period.

13. An apparatus for controlling air-fuel ratio learning of an internal combustion engine according to claim 11, wherein said air-fuel ratio learning correction value updating/setting means carries out, in said operating region, updating/setting to a new air-fuel ratio learning correction value based on an average value of, currently obtained air-fuel ratio feedback correction values which have been increasingly weighted the later the acquisition order thereof, and the air-fuel ratio learning correction value prior to updating/setting.

14. An apparatus for controlling air-fuel ratio learning of an internal combustion engine according to claim 11, wherein said air-fuel ratio learning correction value updating/setting means carries out, in said operating region, updating/setting to a new air-fuel ratio learning correction value by subjecting an averaged value of currently obtained air-fuel ratio feedback correction values which have been increasingly weighted the later the acquisition order thereof, and the air-fuel ratio learning correction value prior to updating/setting, to an averaging treatment wherein the weighting of said averaged values is increased in accordance with an increase in the number of acquisitions of the air-fuel ratio feedback correction value within a predetermined period.

* * * * *